US009201380B2

(12) United States Patent
Wakayama

(10) Patent No.: US 9,201,380 B2
(45) Date of Patent: Dec. 1, 2015

(54) STATIC ELIMINATING DEVICE AND IMAGE FORMING APPARATUS

(71) Applicant: KYOCERA Document Solutions Inc., Osaka (JP)

(72) Inventor: Kei Wakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/332,872

(22) Filed: Jul. 16, 2014

(65) Prior Publication Data

US 2015/0030351 A1 Jan. 29, 2015

(30) Foreign Application Priority Data

Jul. 29, 2013 (JP) ..... 2013-156911

(51) Int. Cl.
*G03G 21/00* (2006.01)
*G03G 21/08* (2006.01)

(52) U.S. Cl.
CPC ..... *G03G 21/08* (2013.01)

(58) Field of Classification Search
CPC ..... G03G 21/08; H05F 3/00
USPC ..... 399/128
See application file for complete search history.

(56) References Cited

U.S. PATENT DOCUMENTS 7,421,229 B2 9/2008 Tomiie et al.
2002/0172530 A1* 11/2002 Kido et al. ..... 399/128

FOREIGN PATENT DOCUMENTS

JP 2006-234882 A 9/2006

* cited by examiner

*Primary Examiner* — Hoang Ngo
(74) *Attorney, Agent, or Firm* — Studebaker & Brackett PC

(57) ABSTRACT

A static eliminating device includes a light emitting part and an optical path providing part. The light emitting part emits a static eliminating light to a surface of an image carrier. The optical path providing part includes a reflecting face reflecting the static eliminating light and a radiation end from which the static eliminating light is radiated to the surface of the image carrier. The reflecting face is a matted face.

14 Claims, 9 Drawing Sheets

STATIC ELIMINATING DEVICE AND IMAGE FORMING APPARATUS

INCORPORATION BY REFERENCE

This application is based on and claims the benefit of priority from Japanese Patent application No. 2013-156911 filed on Jul. 29, 2013, the entire contents of which are incorporated herein by reference.

BACKGROUND

The present disclosure relates to a static eliminating device eliminating a static charge remained on a surface of a photosensitive drum and an image forming apparatus including this static eliminating device.

In an electrographic image forming apparatus, in order to reduce a transfer memory image occurred by a static charge remained on a surface of a photosensitive drum after a toner (a developer) is transferred, a static eliminating device irradiates the surface of the photosensitive drum with a static elimination light after the toner transfer to eliminate the static charge from the surface of the photosensitive drum.

The static eliminating device is often arranged between a charging device and a cleaning device removing adhesive, such as the toner, remained on the surface of the photosensitive drum after the toner transfer. Therefore, if rotating speed of the photosensitive drum is increased due to acceleration of the image forming apparatus, a time from the static elimination of the photosensitive drum by the static elimination device to next electrical charging in the charging device is remarkably shortened, and then, a carrier (static charge) trapped in a photosensitive layer may be insufficiently eliminated by the static elimination device. In such a case, next electrical charging is carried out while the carrier is remained on the photosensitive drum, and accordingly, there is a problem that a defective image called as the transfer memory image is easily occurred.

In order to solve this problem, there is an image forming apparatus configured so that the static eliminating device is positioned at an upstream side from the cleaning device in a rotating direction of the photosensitive drum to provide a wide interval from the static elimination device to the charging device, and then, to secure a sufficient time for removing the trapped carrier.

In a case where the static eliminating device is arranged at the upstream side from the cleaning device, although the static eliminating device is positioned at a downstream side from a transferring device, a toner not transferred on a sheet and a toner scattered after the transfer onto the sheet are floated near the transferring device. If such non-transferred toner or scattered toner is adhered onto alight emitting part of the static eliminating device, there is a possibility of reducing a light amount of the static elimination light.

In order to solve such a problem, in a case where the static eliminating device is arranged at the upstream side from the cleaning device in the rotating direction of the photosensitive drum, a partition member is arranged between the static eliminating device and transfer device so that the static eliminating device does not directly face to the transferring device and a conveying path of the sheet, and accordingly, adhesion of the toner onto the light emitting part is prevented.

In a case of arranging the partition member, a space between a housing supporting the static elimination device and partition member provides an optical path of the static elimination light. A part of the static elimination light is reflected by faces at the optical path side (called as reflecting faces) of the housing and partition member and progressed, and then, radiated from an opening end between the housing and partition member to the photosensitive drum. Since the light amount of the static elimination light radiating to the photosensitive drum depends upon reflectance of the reflecting faces of the housing and partition member, the light amount of the static elimination light is increased as the reflectance of the reflecting faces is heightened. In addition, since the reflectance depends upon glossiness of the reflecting faces, the reflectance is heightened as the glossiness of the reflecting faces is heightened.

When an image forming operation is continued, the non-transferred toner or scattered toner may penetrate the optical path of the static elimination light from the opening end between the housing and partition member or the other regardless of the arrangement of the partition member.

For example, in a drum unit including the charging device, cleaning device and static elimination device in a body, the static elimination device is supported by a supporting part formed in an outer face of a housing of the drum unit, in accordance with a structure of a die used for molding the housing, an opening may be formed in apart of the supporting part. In such a case, by rotation of the photosensitive drum, a wind along the rotating direction of the photosensitive drum is occurred near the surface of the photosensitive drum. Moreover, a wind path is generated so that the wind penetrates the optical path of the static elimination light from the opening end between the housing and partition member, and then, runs out from the opening formed in the supporting part. If the scattered toner penetrates the optical path along the wind path, there are problems that the penetrated toner is adhered onto the reflecting faces of the housing and partition member, and accordingly, the reflectance of the reflecting faces is decreased.

Further, since the toner amount adhered onto the reflecting faces is uneven in an axial direction of the photosensitive drum, the reflectance is remarkably decreased at a place with much toner adhesion amount and the reflectance is hardly decreased at a place with little toner adhesion amount. Therefore, the light amount of the static elimination light being radiated onto the surface of the photosensitive drum is varied in the axial direction of the photosensitive drum, and then, surface electrical potential on the photosensitive drum after the static elimination becomes uneven. As a result, there is a possibility that a defective image, such as white void in a place with high surface electrical potential, is occurred.

SUMMARY

In accordance with an embodiment of the present disclosure, a static eliminating device includes a light emitting part and an optical path providing part. The light emitting part emits a static eliminating light to a surface of an image carrier. The optical path providing part includes a reflecting face reflecting the static eliminating light and a radiation end from which the static eliminating light is radiated to the surface of the image carrier. The reflecting face is a matted face.

In accordance with an embodiment of the present disclosure, an image forming apparatus includes a static eliminating device. The static eliminating device includes a light emitting part and an optical path providing part. The light emitting part emits a static eliminating light to a surface of an image carrier. The optical path providing part includes a reflecting face reflecting the static eliminating light and a radiation end from which the static eliminating light is radiated to the surface of the image carrier. The reflecting face is a matted face.

The above and other objects, features, and advantages of the present disclosure will become more apparent from the following description.

DETAILED DESCRIPTION

In the following, with reference the drawings, a static eliminating device and an image forming apparatus according to an embodiment of the present disclosure will be described.

Figure 1:
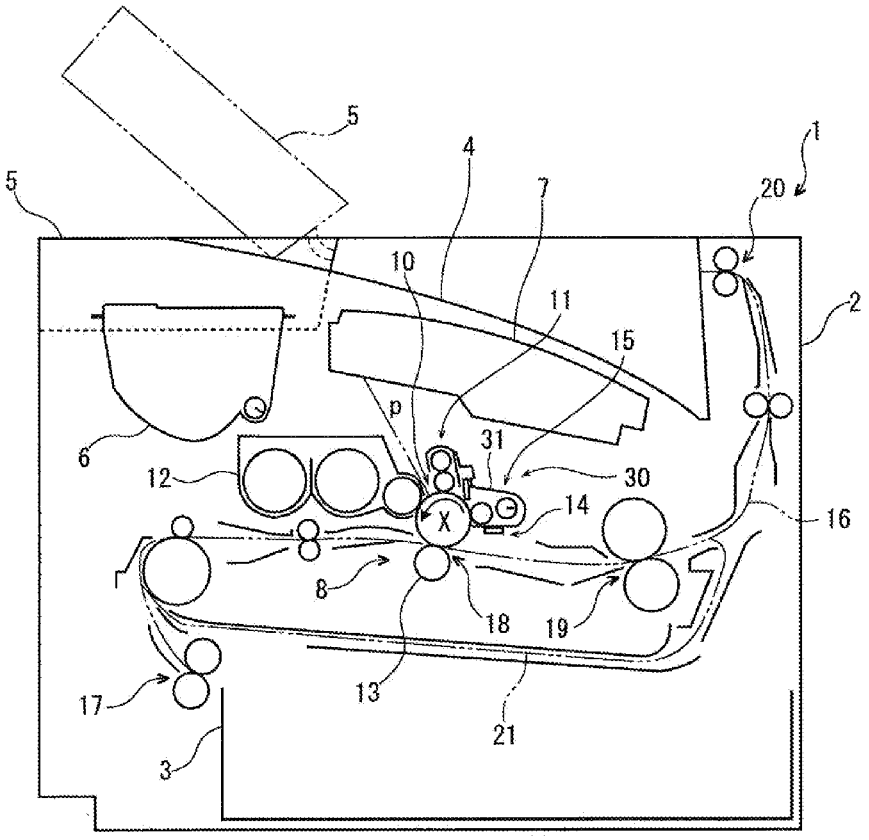
FIG. 1 is a schematic diagram schematically showing a structure of a printer according to an embodiment of the present disclosure.

First, with reference to FIG. 1, the structure of a printer 1 as an electrographic image forming apparatus according to the embodiment of the present disclosure will be described. FIG. 1 is a schematic diagram schematically showing the printer according to the embodiment of the present disclosure. Hereinafter, the front side of the printer 1 indicates the left-hand side of FIG. 1 and orthogonal directions to forward and backward directions viewed from the front side indicate left and right directions.

As shown in FIG. 1, the printer 1 includes a box-like formed printer main body 2. In a lower part of the printer main body 2, a sheet feeding cartridge 3 storing sheets (not shown) is installed and, in a top face of the printer main body 2, a sheet ejected tray 4 is formed. To the front side of the sheet ejected tray 4, an upper cover 5 is openably/closably attached. Below the upper cover 5, a toner container 6 as a toner case containing a toner is installed.

In an upper part of the printer main body 2, an exposure device 7 is located below the sheet ejected tray 4. Below the exposure device 7, an image forming part 8 is arranged. In the image forming part 8, a photosensitive drum 10 as an image carrier is rotatably arranged. Around the photosensitive drum 10, a charging device 11, a development device 12 as an attachment member, a transfer roller 13, a static eliminating device 14 and a cleaning device 15 are located in order along a rotating direction (refer to an arrow X in FIG. 1) of the photosensitive drum 10. The photosensitive drum 10, charging device 11, cleaning device 15 and static eliminating device 14 are supported by a housing 31 and integrated as a drum unit 30. Incidentally, the drum unit 30 will be described later.

Inside the printer main body 2, a conveying path 16 for the sheet is arranged. At an upstream end in the conveying path 16, a sheet feeder 17 is positioned. At an intermediate stream part in the conveying path 16, a transferring part 18 composed of the photosensitive drum 10 and transfer roller 13 is positioned. At a downstream part in the conveying path 16, a fixing device 19 is positioned. At a downstream end in the conveying path 16, a sheet ejecting part 20 is positioned. Below the conveying path 16, an inversion path 21 for duplex printing is arranged.

When the power is supplied to the printer 1, initial determination, such as temperature determination of the fixing device 19, is carried out. Subsequently, in the printer 1, when a printing start is directed, image forming operation is carried out as follows.

First, the surface of the photosensitive drum 10 is electric-charged by the charging device 11. Then, photographic exposure corresponding to image data on the photosensitive drum 10 is carried out by a laser light (refer to a two-dot chain line p in FIG. 1) from the exposure device 7, thereby forming an electrostatic latent image on the surface of the photosensitive drum 10. Subsequently, the development device 12 develops the electrostatic latent image to a toner image by a toner.

On the other hand, the sheet picked up from the sheet feeding cartridge 3 by the sheet feeder 17 is conveyed to the transferring part 18 in a suitable timing for the above-mentioned image forming operation, and then, the toner image on the photosensitive drum 10 is transferred onto the sheet in the transferring part 18. The sheet with the transferred toner image goes into the fixing device 19, and then, the toner image is fixed on the sheet in the fixing device 19. The sheet with the fixed toner image is ejected from the sheet ejecting part 20 to the sheet ejected tray 4. An electrical potential remained on the photosensitive drum 10 in the image forming process is eliminated by the static eliminating device 14. The toner remained on the photosensitive drum 10 is collected by the cleaning device 15.

Figure 2:
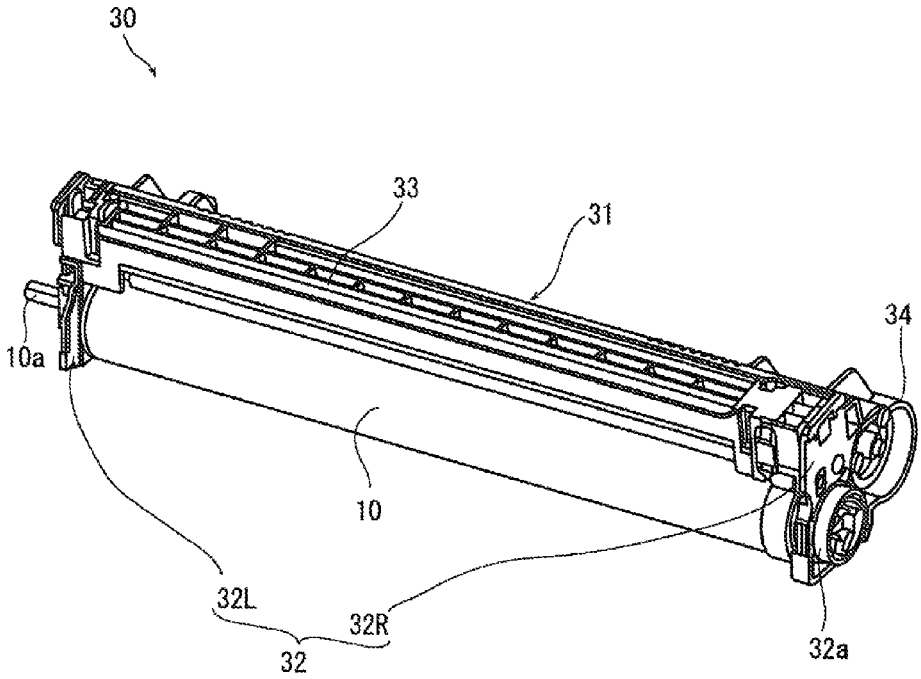
FIG. 2 is a perspective view showing a drum unit viewed from the front side in the printer according to the embodiment of the present disclosure.
Figure 3:
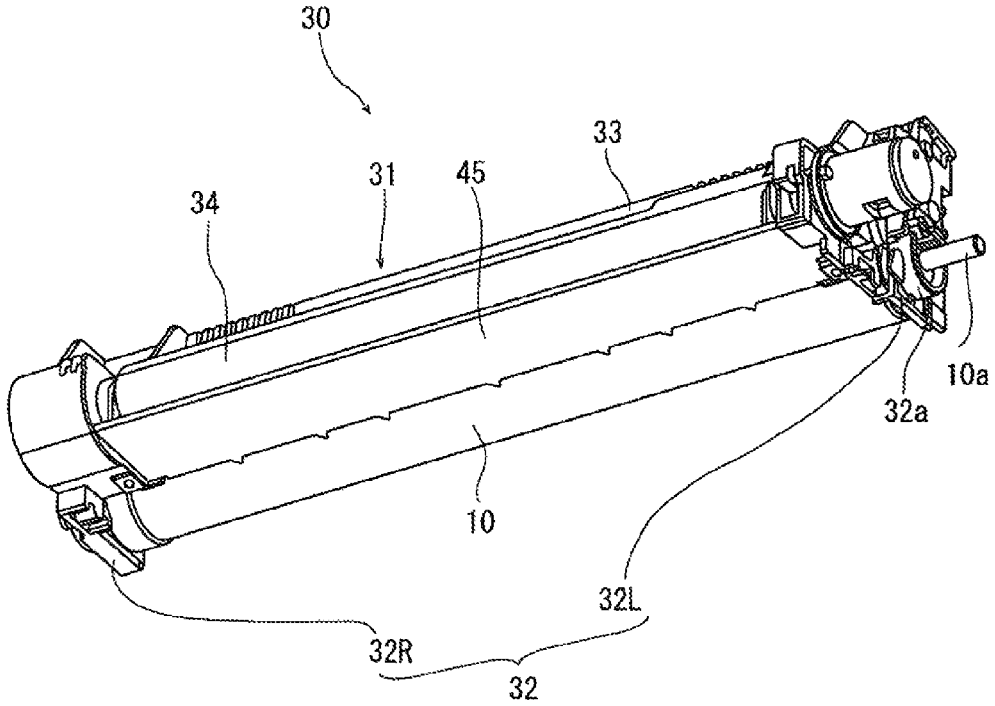
FIG. 3 is a perspective view showing the drum unit viewed from the back side in the printer according to the embodiment of the present disclosure.
Figure 4:
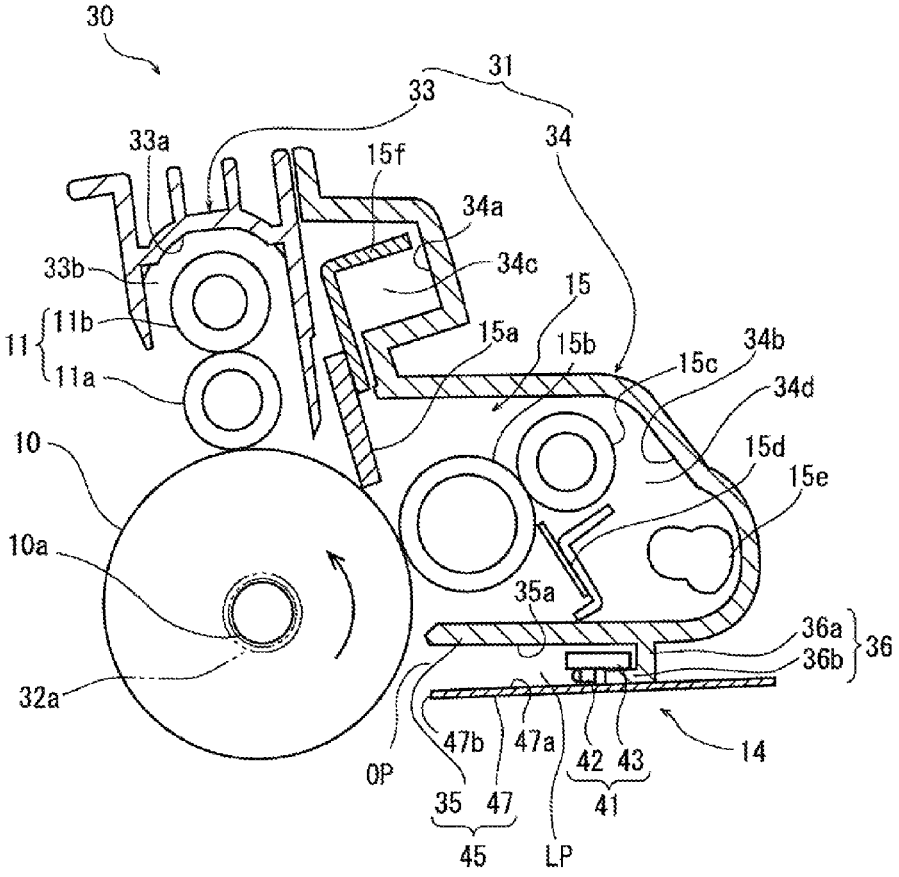
FIG. 4 is a side view showing the drum unit in the printer according to the embodiment of the present disclosure.

Next, with reference to FIGS. 2, 3 and 4, the housing 31, photosensitive drum 10, charging device 11, cleaning device 15 and static eliminating device 14 constituting the drum unit 30 will be described in detail. FIG. 2 is a perspective view showing the drum unit viewed from the front side. FIG. 3 is a perspective view showing the drum unit viewed from the back side. FIG. 4 is a side view of the drum unit.

The housing 31 is a box-like member elongated in the left and right directions and includes left and right side boards 32L and 32R, a small frame part 33 and a large frame part 34. The side boards 32L and 32R face to each other at an interval equal to a length in an axial direction of the photosensitive drum 10. The small frame part 33 and large frame part 34 are bridged between the left and right side boards 32L and 32R. As a material of the housing 31, high impact polystyrene (HIP) may be applied.

In front lower portions of the left and right side boards 32L and 32R, bearing parts 32*a* are formed.

As shown in FIG. 4, the small frame part 33 is a member elongated in the left and right directions and has a concave part 33*a* formed in roughly U-shape in the side view. The small frame part 33 is located so that left and right openings of the concave part 33*a* face to the bearing parts 32*a* of the left and right side boards 32L and 32R (not shown in FIG. 4, but refer to FIGS. 2 and 3). Both left and right ends of the small frame part 33 are fixed to the left and right side boards 32L and 32R. Thereby, both left and right ends of the U-shaped concave part 33*a* are closed by the left and right side boards 32L and 32R to form a storing part 33*b* in the small frame part 33.

The large frame part 34 is a member elongated in the left and right directions and has an upper concave part 34*a* formed in roughly U-shape in the side view and a lower concave part 34*b* formed in roughly U-shape in the side view, which are arranged vertically. The large frame part 34 is located so that a front opening of the upper concave part 34*a* faces to an outer face of the small frame part 33 and left and right openings of the lower concave part 34*b* face to the bearing parts 32*a* of the left and right side boards 32L and 32R. Both left and right ends of the large frame part 34 are fixed to the left and right sideboards 32L and 32R. Thereby, both left and right ends of a concave part surrounded by the upper concave part 34*a* and small frame part 33 are closed by the left and right side boards 32L and 32R to forma storing part (an upper storing part) 34*c* in the large frame part 34. In addition, both left and right ends of the lower concave part 34*b* are closed by the left and right side boards 32L and 32R to form a storing part 34*d* (a lower storing part) in the large frame part 34.

A lower piece 35 (hereinafter, called as a housing lower piece 35) of the lower concave part 34*b* in large frame part 34 is formed in a roughly flat plate shape and has a flat lower face 35*a*. The lower face 35*a* is subjected to matting treatment so as to obtain predetermined glossiness. In the lower face 35*a* of the housing lower piece 35, a supporting part 36 is formed. The supporting part 36 is formed so as to extend in the left and right directions at a rear side position of the lower face 35*a*. The supporting part 36 is formed in a L-shaped side view and has a base part 36*a* extending downward from the lower face 35*a* and a leading part 36*b* extending forward from a leading end of the base part 36*a*.

The photosensitive drum 10 has a rotation shaft 10*a* supported by the bearing parts 32*a* of the left and right side boards 32L and 32R (refer to FIGS. 2 and 3) of the housing 31 and is arranged rotatably around the rotation shaft 10*a*.

The charging device 11 includes a charging roller 11*a* and a charge cleaning roller 11*b* and is supported in the storing part 33*b* of the small frame part 33 of the housing 31. The charging roller 11*a* contacts and electrically charges the photosensitive drum 10. The charging roller 11*a* faces to a lower end of the storing part 33*b* to contact with a surface of the photosensitive drum 10 and the charge cleaning roller 11*b* is positioned at a depth side (an inner side) of the storing part 33*b*.

The cleaning device 15 includes a cleaning blade 15*a*, a cleaning roller 15*b*, a feeding roller 15*c*, a regulating member 15*d* and a collecting spiral 15*e*. The cleaning blade 15*a* comes into contact with the surface of the photosensitive drum 10 to scrap the remained toner. The cleaning roller 15*b* applies the toner to the surface of the photosensitive drum 10. The feeding roller 15*c* feeds the toner to the cleaning roller 15*b*. The regulating member 15*d* regulates a toner amount of the cleaning roller 15*b*. The collecting spiral 15*e* collects the scraped toner.

The cleaning blade 15*a* is supported by a supporting member 15*f* so as to come into contact with the surface of the photosensitive drum 10 in a counter direction to rotation of the photosensitive drum 10. The supporting member 15*f* is supported in the upper storing part 34*c* of the large frame part 34.

The cleaning roller 15*b* is positioned so as to face to the front end of the lower storing part 34*d* and to contact with the photosensitive drum 10. Along the external circumference of the cleaning roller 15*b*, the feeding roller 15*c* and regulating member 15*d* are positioned. The collecting spiral 15*e* is positioned at a deepest side (an innermost side) of the lower storing part 34*d*.

The static eliminating device 14 includes a light emitting part 41 emitting a static eliminating light to the surface of the photosensitive drum 10 and an optical path providing part 45 providing an optical path of the static eliminating light.

Figure 5:
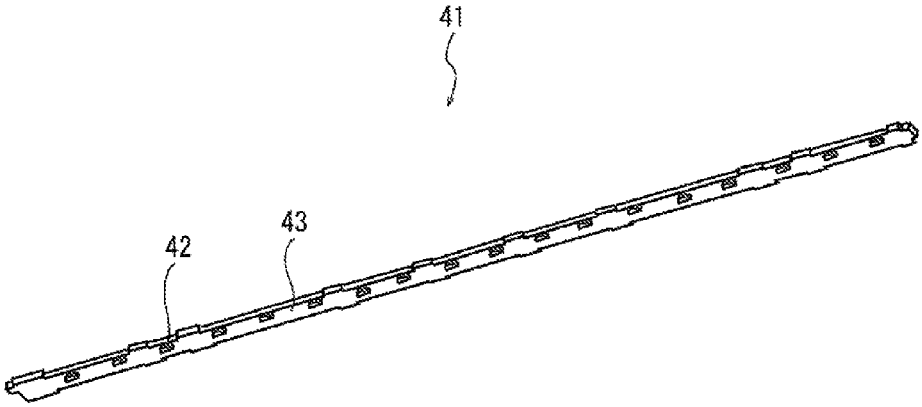
FIG. 5 is a perspective view showing a light emitting part of a static eliminating device in the printer according to the embodiment of the present disclosure.

With reference to FIG. 5, the light emitting part 41 of the static eliminating device 14 will be described.

The light emitting part 41 has illuminants 42 emitting the static eliminating light and a substrate 43 to which the illuminants 42 are attached. As the illuminants 42, a plurality of light emitting device (LED) chips may be applied. The substrate 43 has a length roughly equal to the length in the axial direction of the photosensitive drum 10. In a lower face of the substrate 43, a plurality of the illuminants 42 are packaged at predetermined intervals. As shown in FIG. 4, the light emitting part 41 is supported by the leading part 36*b* of the supporting part 36 formed in the large frame part 34 so that light emitting faces of the illuminants 42 face to the front side.

As shown FIG. 4, the optical path providing part 45 is composed of a partition board 47 preventing toner adhesion to the light emitting part 41 and the housing lower piece 35. The partition board 47 is positioned so as to face to the lower side of the housing lower piece 35. A roughly center part in the forward and backward directions of the partition board 47 is attached to a lower face of the leading part 36*b* of the supporting part 36 by a double sided tape, a gluing or the like. Thereby, between the housing lower piece 35 and light emitting part 41, a slit like optical path LP is provided so as to run from the light emitting part 41 to the surface of the photosensitive drum 10. The lower face 35*a* of the housing lower piece 35 and an upper face 47*a* of the partition board 47 provide reflecting faces reflecting the static eliminating light. A front end of the optical path LP facing to the surface of the photosensitive drum 10 provides a radiation end OP from which the static eliminating light is radiated.

Figure 6:
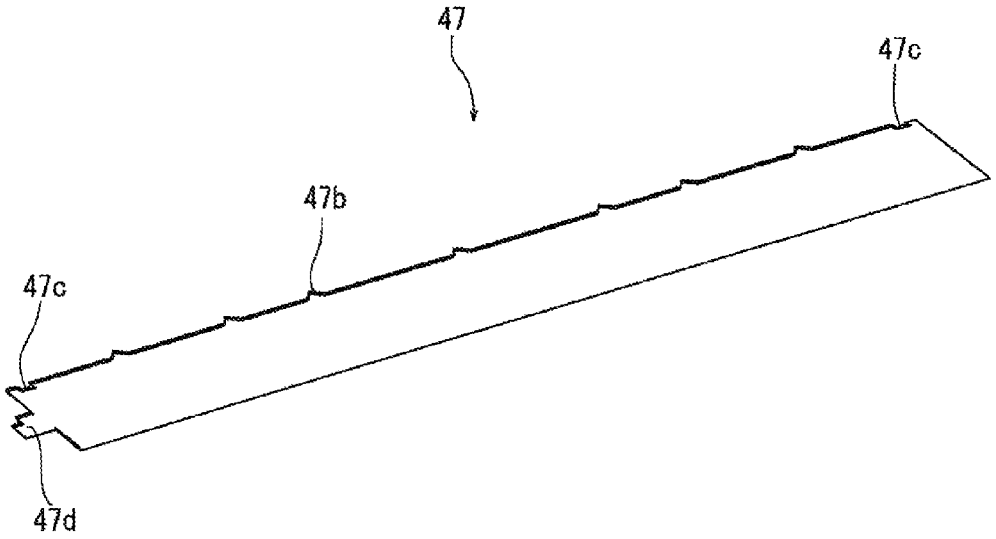
FIG. 6 is a perspective view showing a partition board of the static eliminating device in the printer according to the embodiment of the present disclosure.

As shown in FIG. 6, the partition board 47 will be described.

The partition board 47 is a rectangular flat board having a flat face shape elongated in the left and right directions. The partition board 47 has a length in the left and right directions (width) being roughly equal to the length of the substrate 43 of the light emitting part 41 and a length in the forward and backward directions being roughly equal to a length in the forward and backward directions of the housing lower piece 35. Along a front edge of the partition board 47, a plurality of claws 47*b* are formed at predetermined intervals. The claws 47*b* are separating claws separating the sheet adhered on the photosensitive drum 10 after the toner transfer. In the vicinity of both ends of the front edge, positioning recess parts (positioning part) 47*c* to the large frame part 34 are formed. In a left edge of the partition board 47, a protruding piece 47*d* protruding outside is formed. The protruding piece 47*d* is configured to hind an end part of the substrate 43 of the light emitting part 41 when the partition board 47 is attached to the large frame part 34.

The partition board 47 is formed by matted polycarbonate (PC) or matted polyethylene terephthalate (PET) to have glossiness as that in a condition where a certain toner is adhered in advance.

The lower face 35*a* of the housing lower piece 35, similarly to the partition board 47, is subjected to the matting treatment is applied so as to have the glossiness in a condition where a certain toner is adhered in advance. The matting treatment is a surface treatment manner preventing the reflection of the light and is carried out in order to decrease the glossiness. As concrete examples of the treatment manner, embossing treatment forming wrinkle pattern on the surface, blackening treatment or the like may be cited.

Figure 7:
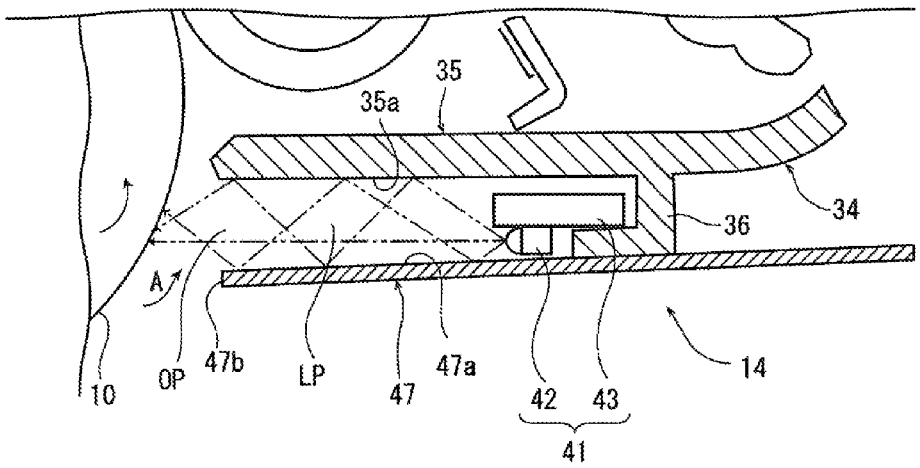
FIG. 7 is a side view showing the periphery of the static eliminating device in the printer according to the embodiment of the present disclosure.

Next, an action of the static eliminating device 14 having an above-mentioned configuration will be described with reference to FIG. 7. FIG. 7 is a side view showing the periphery of the static eliminating device.

When the light is emitted from the illuminants 42 of the light emitting part 41 of the static eliminating device 14 at a predetermined radiation angle, as indicated by two-dot chain lines in FIG. 7, the light goes straight or advances while being reflected by the upper face 47*a* of the partition board 47 and the lower face 35*a* of the housing lower piece 35. Then, the light is radiated from the radiation end OP between the partition board 47 and housing lower piece 35 to the photosensitive drum 10.

When the image forming operation is repeated, a non-transferred toner or a scattered toner is floated near the static eliminating device 14. By the rotation of the photosensitive drum 10, an air current along the rotation direction is generated around the surface of the photosensitive drum 10. In a case where a wind path from the radiation end OP of the optical path to the back side of the light emitting part 41 is generated, as indicated by a solid line arrow A in FIG. 7, the scattered toner penetrates the optical path from the radiation end OP along the air current. These toners mainly fall by gravitation and are adhered on the upper face 47*a* of the partition board 47. The toners may be adhered to the lower face 35*a* of the housing lower piece 35 by electrostatic force or the like. Due to the adhesion of the toners, the glossiness of the upper face 47*a* of the partition board 47 and the lower face 35*a* of the housing lower piece 35 as the reflecting faces is decreased.

As described above, in the printer 1 according to the embodiment of the present disclosure, since the upper face 47*a* of the partition board 47 and the lower face 35*a* of the housing lower piece 35 as the reflecting faces have the same glossiness as that in a condition where a certain toner is adhered in advance, if the toner is adhered on the faces, decreasing degree of the glossiness is small. Therefore, if adhesion amounts of the toner penetrating the optical path are different in the left and right directions, since a difference in light amounts of the static eliminating light caused due to the difference of the adhesion amounts is hardly generated in the left and right directions, it is possible to radiate the static eliminating light with roughly even light amounts in the left and right directions.

In this static eliminating device 14, although the light amount of the static eliminating light radiated to the surface of the photosensitive drum 10 may be decreased, there is no problem since the light amount of the degree enough to eliminate remained electrical potential may be secured. Even if the light amount is decreased, it is preferable to radiate the static eliminating light with roughly equal light amounts in the left and right directions, in comparison with a case of different light amounts in the left and right directions. Incidentally, the decrease in the light amount of the static eliminating light can be compensated by using the light emitting parts with large power or other means.

Figure 8:
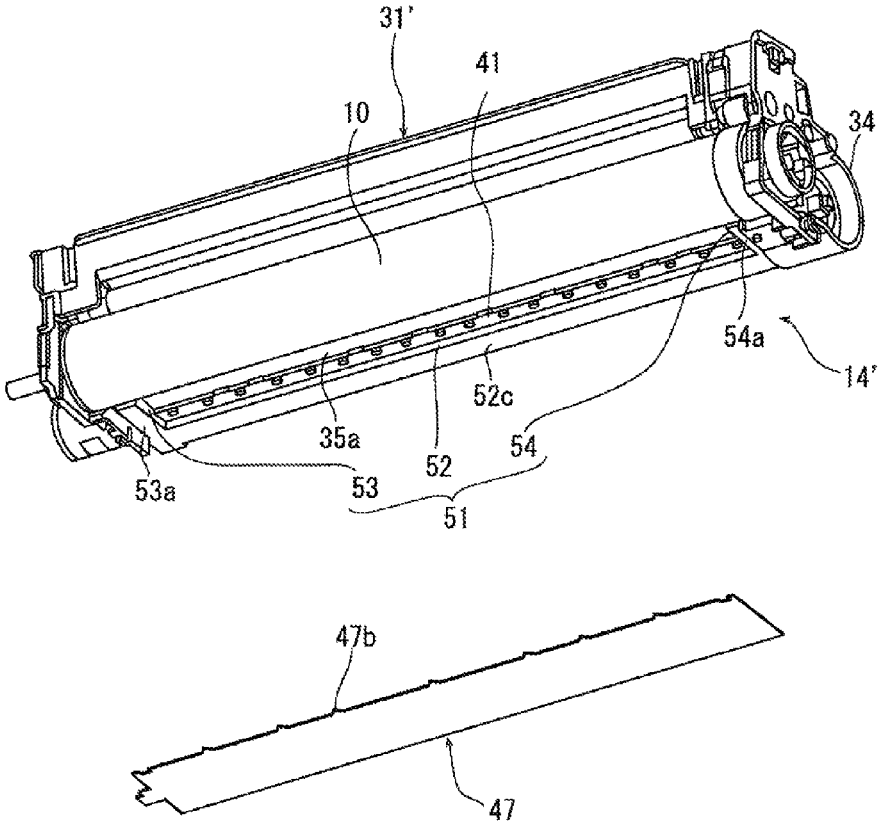
FIG. 8 is a partial exploded perspective view showing a drum unit in a printer according to another example of the embodiment of the present disclosure.
Figure 9:
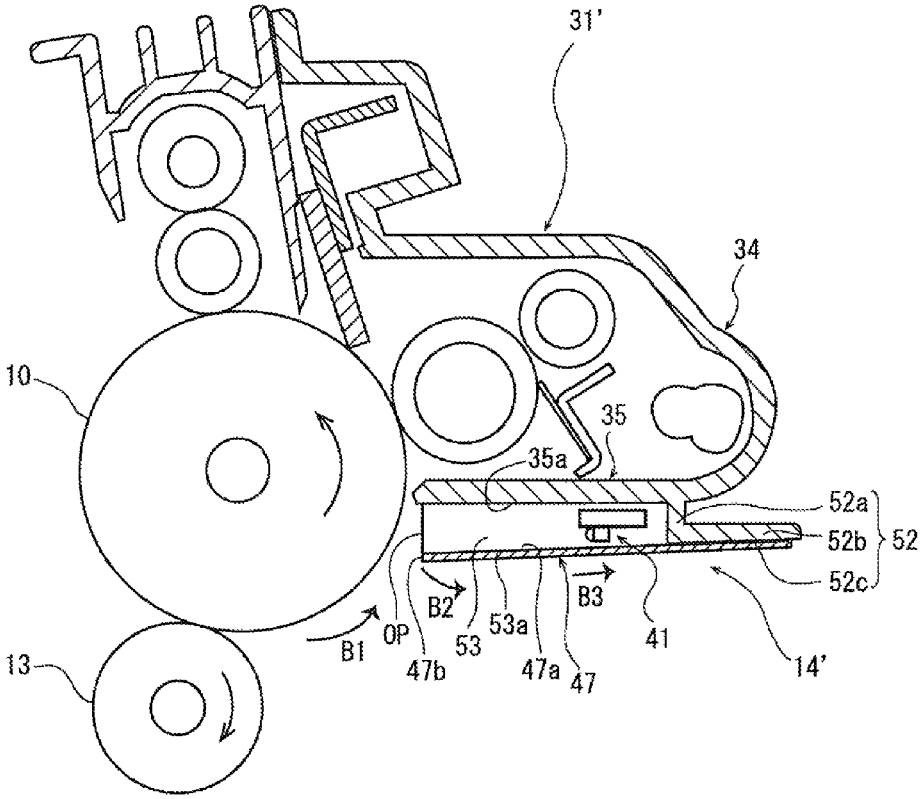
FIG. 9 is a side view showing the drum unit in the printer according to another example of the embodiment of the present disclosure.

Next, with reference to FIGS. 8 and 9, a static eliminating device 14' as another example according to the embodiment will be described. FIG. 8 is a perspective view showing a drum unit and a partition board. FIG. 9 is a side view of the drum unit. In FIGS. 8 and 9, similar components to the static eliminating device of the above-mentioned embodiment are indicated by the same reference numerals as FIG. 4 and detail descriptions of the similar components are omitted.

In this static eliminating device 14', a supporting part 51 supporting the partition board 47 is formed in the lower face 35*a* of the housing lower piece 35. The supporting part 51 includes, as shown in FIG. 8, a rear wall 52 and left and right side walls 53 and 54 connected to both left and right ends of the rear wall 52.

As shown in FIG. 9, the rear wall 52 is formed so as to extend in the left and right direction at the back side of the light emitting part 41. Both left and right ends of the rear wall 52 are extended to the outside from both left and right ends of the light emitting part 41. The rear wall 52 is formed to be higher than a height from the lower face 35*a* of the housing lower piece 35 to the light emitting part 41. The rear wall 52 is formed in an L-shape in the side view to have a base part 52*a* extending downward and a leading part 52*b* extending backward from a leading end of the base part 52*a*.

The left and right side walls 53 and 54 are formed so as to extend in the forward and backward directions at both left and right sides of the light emitting part 41. Rear ends of the left and right side walls 53 and 54 are connected to the both left and right ends of the rear wall 52. Heights of the left and right side walls 53 and 54 are equal to the height of the rear wall 52. Respective lower faces 53*a* and 54*a* of the left and right side walls 53 and 54 and a lower face 52*c* of the leading part 52*b* of the rear wall 52 constitute a continuous flat face.

The partition board 47 is attached to the lower face 52*c* of the rear wall 52 and the lower faces 53*a* and 54*a* of the left and right side walls 53 and 54 in the supporting part 51 by a double sided tape, a gluing or the like, in a state of directing the claws 47*b* forward. Thereby, a space is provided so as to be surrounded vertically by the housing lower piece 35 and partition board 47 and to be surrounded horizontally by the left and right side walls 53 and 54. The back side of the space is surrounded by the back wall 52 and the front side of the space is opened to face to the photosensitive drum 10. This space provides the optical path of the static eliminating light. The upper face 47*a* of the partition board 47 and the lower face 35*a* of the housing lower piece 35 provide the reflecting faces of the static eliminating light. The front end facing to the surface of the photosensitive drum 10 provides the radiation end OP of the static eliminating light.

In the static eliminating device 14' of this other example, the optical path are closed except for the radiation end OP. Therefore, when the air current (refer to an arrow B1 in FIG. 9) along the rotation direction is generated around the surface of the photosensitive drum 10 by the rotation of the photosensitive drum 10 and then reaches the vicinity of the radiation end OP, the air current runs along the lower face of the partition board 47 (refer to arrows B2 and B3 in FIG. 9) without penetrating the optical path. Therefore, there is a very low possibility that the scattered toner penetrates the optical path. If the toner may penetrate the optical path, as described in the first embodiment, since the upper face 47*a* of the partition board 47 and the lower face 35*a* of the housing lower piece 35 have low glossiness, influence due to the toner adhesion is hardly received.

In the above-described embodiments of the present disclosure, as the material of the partition board 47, originally matted material is used and the glossiness of the lower face 35*a* of the housing lower piece 35 is reduced by the matting treatment. However, reduction manner of the glossiness of the partition board 47 and housing 31 is restricted from these. A quality or color of the material of the partition board 47 and housing 31 may be suitable chosen, or treatment manner may be chosen according to the quality or color of the material. Alternatively, the originally matted material may be subjected to the matting treatment. Further alternatively, only the reflecting face of the partition board 47 may be subjected to the matting treatment.

Although, in the embodiments, the glossiness of both the partition board 47 and housing 31 is reduced, the glossiness of only the partition board 47 may be reduced. As described above, since the toner penetrating the optical path easily falls to the partition board 47 by the gravitation to be adhered, it is possible to obtain excellent effect by subjecting only the partition board 47 to the treatment reducing the glossiness.

Although, in the embodiment, the example of reducing the glossiness of the partition board 47 and housing 31 and closing the wind path of the static eliminating device 14 was described, it is possible to obtain excellent effect by only closing the wind path. Therefore, in a case where the glossiness of the reflecting face cannot be reduced to a predetermined value due to material of the partition board 47 and housing 31 and others, it is preferable to apply the manner of closing the wind path together with the reduction of the glossiness.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A static eliminating device comprising:

a light emitting part emitting a static eliminating light to a surface of an image carrier; and an optical path providing part including a reflecting face reflecting the static eliminating light and a radiation end from which the static eliminating light is radiated to the surface of the image carrier, wherein the reflecting face is a matted face, the optical path providing part includes a housing supporting light emitting part and a partition board located so as to face to the lower side of the housing, the housing and partition board are configured so that, between the housing and partition board, a slit like optical path is provided so as to run from the light emitting part to the surface of the image carrier, opposite faces of the housing and partition board provide reflecting faces, and an end of the optical path at a side facing to the surface of the image carrier provides the radiation end, the face of the partition board opposite to the housing is a matted face.

2. The static eliminating device according to claim 1, wherein the face of the housing opposite to the partition board is a matted face.

3. The static eliminating device according to claim 1, wherein the optical path is closed by the housing and the partition board except for the radiation end.

4. The static eliminating device according to claim 1, wherein the partition board includes a separating claw separating a sheet.

5. The static eliminating device according to claim 1, wherein the partition board is formed by matted polycarbonate (PC) or matted polyethylene terephthalate (PET).

6. The static eliminating device according to claim 1, wherein the partition board has a width roughly equal to a length in an axial direction of the image carrier, and includes a positioning part positioning the partition board to the housing so that an image carrier side end of the partition board is roughly matched to an image carrier side end of the housing.

7. The static eliminating device according to claim 1, wherein the housing supports the image carrier.

8. An image forming apparatus comprising:

a static eliminating device, wherein the static eliminating device includes:

a light emitting part emitting a static eliminating light to a surface of an image carrier; and an optical path providing part including a reflecting face reflecting the static eliminating light and a radiation end from which the static eliminating light is radiated to the surface of the image carrier, wherein the reflecting face is a matted face, the optical path providing part includes a housing supporting light emitting part and a partition board located so as to face to the lower side of the housing, the housing and partition board are configured so that, between the housing and the partition board, a slit like optical path is provided so as to run from the light emitting part to the surface of the image carrier, opposite faces of the housing and partition board provides become reflecting faces, and an end of the optical path at the side facing to the surface of the image carrier provides the radiation end, the face of the partition board opposite to the housing is a matted face.

9. The image forming apparatus according to claim 8, wherein the face of the housing opposite to the partition board is a matted face.

10. The image forming apparatus according to claim 8, wherein the optical path is closed by the housing and partition board except for the radiation end.

11. The image forming apparatus according to claim 8, wherein the partition board includes a separating claw separating a sheet.

12. The image forming apparatus according to claim 8, wherein the partition board is formed by matted polycarbonate (PC) or matted polyethylene terephthalate (PET).

13. The image forming apparatus according to claim 8, wherein the partition board has a width roughly equal to a length in an axial direction of the image carrier, and includes a positioning part positioning the partition board to the housing so that an image carrier side end of the partition board is roughly matched to an image carrier side end of the housing.

14. The image forming apparatus according to claim 8, wherein the housing supports at least one of the image carrier, a charging device and a cleaning device.

* * * * *